United States Patent [19]

Shibahara

[11] 4,033,220

[45] July 5, 1977

[54] TEMPO SETTING DEVICE

[75] Inventor: Masashi Shibahara, Kishiwada, Japan

[73] Assignee: Nihon Hammond Kabushiki Kaisha, Osaka, Japan

[22] Filed: June 9, 1975

[21] Appl. No.: 585,403

[30] Foreign Application Priority Data

June 12, 1974 Japan ..... 49-67466

[52] U.S. Cl. ..... 84/1.03

[51] Int. Cl.[2] ..... G10F 1/00

[58] Field of Search ..... 84/1.01, 1.03, DIG. 12, 84/484

[56] References Cited

UNITED STATES PATENTS

| | | | |
|---|---|---|---|
| 3,516,321 | 6/1970 | Harris | 84/1.26 |
| 3,548,065 | 12/1970 | Freeman | 84/1.03 |
| 3,787,601 | 1/1974 | Campbell | 84/DIG. 12 |
| 3,789,718 | 2/1974 | Bunger | 84/1.01 |

*Primary Examiner*—E. S. Jackmon
*Attorney, Agent, or Firm*—Neuman, Williams, Anderson & Olson

[57] ABSTRACT

A tempo setting device for use in an automatic rhythm instrument comprising a control means actuatable repetitively by the instrument player to produce a plurality of signals at a rate corresponding to a desired tempo and a circuit means responsive to the signals to produce a control signal related in magnitude to the rate. The control signal is applied to a voltage controlled tempo oscillator which is part of the automatic rhythm instrument and has an output frequency determined by the magnitude of its input signal. Thus, by actuating the control means at a rate corresponding to the desired tempo, the instrument player can regulate the tempo of the automatic rhythm instrument.

13 Claims, 6 Drawing Figures

TEMPO SETTING DEVICE

BACKGROUND OF THE INVENTION

The present invention relates to a tempo setting device for use with an automatic rhythm instrument. The tempo setting device enables the player to select the tempo of the rhythm instrument by actuating a control means at the desired tempo.

Under known methods, it is possible for a player to set the desired tempo before beginning to play the instrument by rotating a knob of a rheostat while listening to the rhythm being played. This makes the selection of a different tempo during continuous playing very difficult. Furthermore, this method requires the dual action on the part of the player of playing the instrument with one hand and adjusting the tempo by rotating the knob with the other hand. This procedure is inconvenient and troublesome to the individual player and disturbing to other musicians attempting to play together. Furthermore, taking the time to adjust the tempo during continuous play will break the audience's attention and appreciation of the music.

SUMMARY OF THE INVENTION

The present invention is directed to a device for controlling the tempo of an automatic rhythm instrument. The instrument player actuates a control means at a selectable time. The control means is actuated by the player a predetermined number of times at a rate corresponding to the desired tempo. A circuit means is responsive to the control means to supply to the rhythm instrument a control signal which is a voltage analog corresponding in magnitude to the rate the control means is actuated. The control signal is applied to the input of a voltage controlled tempo oscillator in the automatic rhythm instrument which has its output frequency determined by the magnitude of its input signal.

The control circuit means comprises a switch means actuatable by the instrument player at a rate corresponding to the desired tempo to produce a plurality of tempo indicating signals at that rate and a control logic circuit means responsive to the switch means to produce an operating signal. The operating signal corresponds to the rate at which the switch means is actuated. The circuit means responsive to the operate signal comprises an oscillator means and a logic circuit means. The oscillator means is responsive to the operate signal to produce output pulses. The logic circuit means is responsive to the pulses to produce a control signal which is a voltage analog corresponding in magnitude to the rate the control means is actuated by the instrument player.

The control logic means of the control circuit comprises a pulse converting means responsive to the tempo indicating signals of the switch means. The pulse output of the pulse converting circuit is applied to the input of a digital shift register. The logic output states of predetermined stages of the digital shift register are applied to an output control means to produce the operating signals for the circuit means. The logic output states of other stages of the digital shift register are applied to an inhibit means to disable the pulse converting means from producing pulses.

The control logic circuit of the control means and the logic circuit of the circuit means are both responsive to reset circuit means.

An object of the present invention, is to eliminate the difficult adjustment of tempo by replacing the rotary knob with a tempo setting device which comprises a control means for actuation at a rate corresponding to a desired tempo and a circuit means responsive to the control means to supply to the automatic rhythm instrument a control signal corresponding to the rate.

Another object of the invention is to enable the tempo to be set at the start of playing as well as during playing without disturbing or distracting other musicians or the audience.

A further object of the invention is to control the tempo in correlation to the time interval between a preselected set of two actuations of the control means by the instrument player at the desired tempo.

Other objects of the invention will become apparent by examination of the following detailed description and drawings in which.

Figure 1:
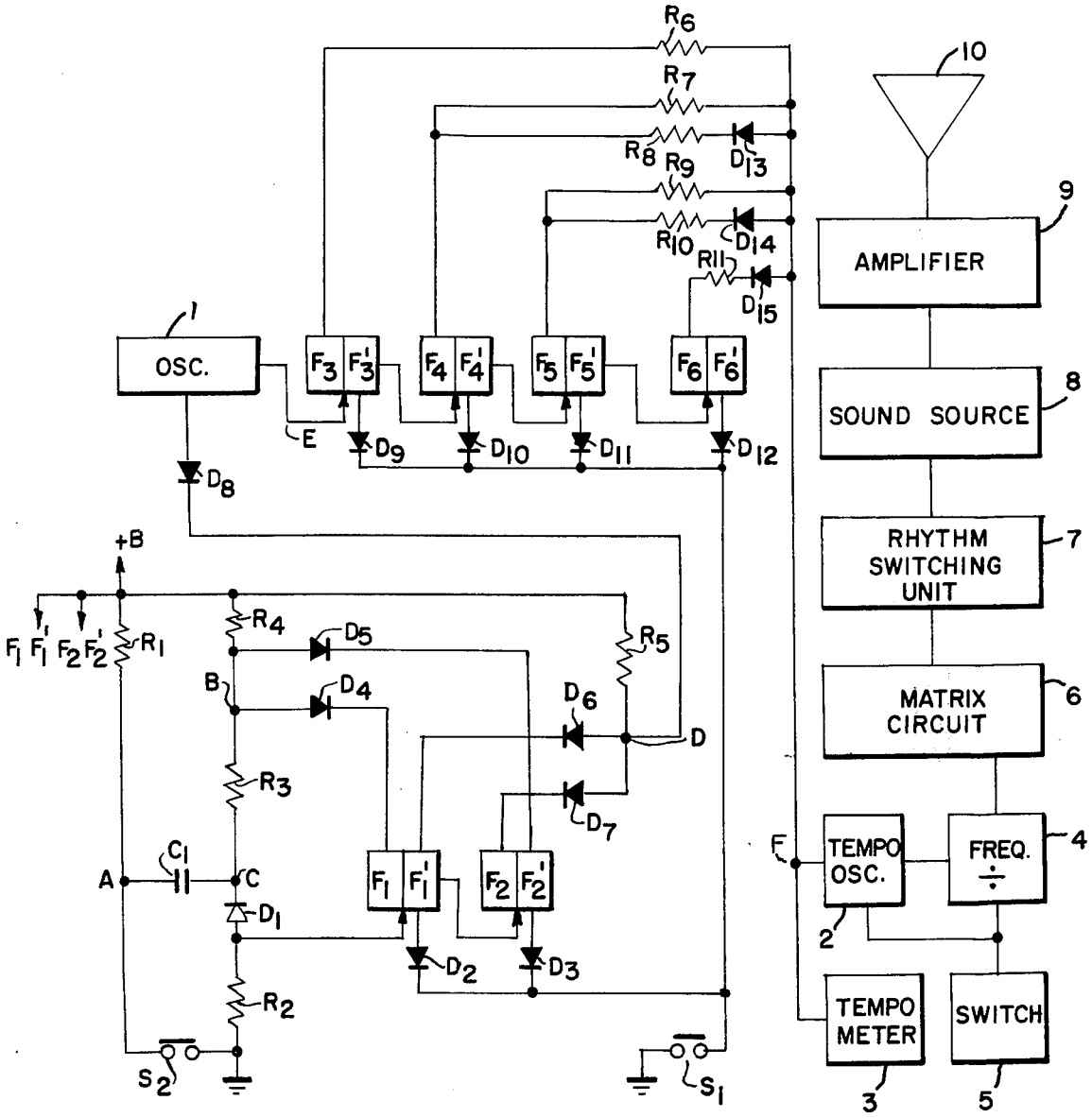
FIG. 1 is a block circuit diagram showing the tempo setting control device.

In the first embodiment, illustrated in FIG. 1, the instrument player resets the entire tempo setting device comprising the control circuit means and the circuit means by actuating the reset switch S1. The instrument player can now select the desired tempo by actuating the control circuit means comprising the switch circuit means and the control logic means at a rate corresponding to the desired tempo.

The switch means is actuated by the instrument player at a rate corresponding to the desired tempo. The actuation of the switch means including switch S2 produces a tempo indicating signal. The tempo indicating signal is applied to the control logic circuit. The pulse converting circuit means of the control logic circuit comprises the capacitor C1 and diode D1 and is responsive to the actuation of the switch S2 to produce an output pulse. Thus, the repetitive actuation of the switch S2 will produce a plurality of tempo indicating signals and the pulse converting circuit will produce a plurality of pulses. The pulses generated by the pulse converter circuit are applied to the input of the digital shift register of the control logic circuit comprising bistable devices F1F'1 and F2F'2. The logic output states of stages F'1 and F2 are connected to the output control circuit of the control logic circuit comprising diodes D6, D7 and D8. The logic output states of stages F1 and F'2 are connected to the inhibit circuit means of the control logic circuit comprising diodes D4 and D5.

The output control circuit produces an operating signal when the stages F'1 and F2 are in a predetermined logic state. The inhibit circuit disables the pulse converting circuit from producing pulses when the stages F1 and F'2 are in a diffrent predetermined logic state. When the pulse converting circuit is disabled, a subsequent actuation of the switch S2 will not cuase the pulse converting circuit to produce a pulse. Only after the reset switch S1 is depressed which resets the logic output state of the stages of the bistable devices in the digital shift register will the inhibit signal be removed and the pulse converting circuit again made responsive to the actuation of the switch means.

The operating signal output is applied to the circuit means comprising an oscillator means 1 and a logic circuit means. The oscillator means produces a pulse output in response to the operating signal. The pulse output is applied as the input signal to the logic means comprising the ripple counter F3F'3 through F6F'6 and associated output circuitry R6; R7, R8 and D13; R9 R10 and D14; and, R11 and D15. The logic circuit means produces a control signal having a magnitude which corresponds to the actuation rate of the switch means. The control signal is applied to the input of a voltage controlled tempo oscillator 2 having its frequency output regulated by the magnitude of its input signal. The voltage controlled tempo oscillator 2 is connected to a standard frequency divider 4 and a starting switch 5. The frequency divider 4 is connected to a standard matrix circuit 6. The output of a matrix circuit 6 is connected to a standard rhythm switching unit 7, the output of the rhythm switching unit 7 to a standard musical sound oscillator 8, the output of which is connected to a standard amplifier 9, the output of which is connected to a standard speaker 10. The above elements 1 through 10 are well-known in the art and further description of them here is considered unnecessary. In FIG. 1, the magnitude of the control signal corresponds to the time interval between the second and third actuations of the switch S2. It should be noted that the selection of a time interval between any set of two switch actuations could be employed with obvious modification in the control logic circuit.

The operation of the tempo setting device of FIG. 1 is as follows. When the reset switch S1 is depressed, the diodes D2, D3, D9, D10, D11 and D12 are turned on. The above diodes being in the on state cause the bistable stages F'1, F'2 of the digital shift register and the bistable stages F'3, F'4, F'5 and F'6 of the logic circuit to be in the off state. The tempo setting device is now reset and in condition to receive from the player the desired tempo.

The switch S2 of the switch circuit means is normally open. The voltage at point A is positive due to the charged capacitor C1 of the pulse converting circuit. The voltage at points B and C is zero due to the fact that the bistable stage F1 is in the on condition causing diode D4 to be on. When the player desires to obtain a particular tempo, the switch S2 is depressed a predetermined number of times at that desired tempo rate. In this embodiment to properly select a desired tempo, the switch S2 must be depressed at least three times with the interval of time between the second and third depression representing the desired tempo.

When the switch S2 is depressed the first time, the voltage at point A goes to zero volts and a negative pulse below zero volts is thus produced at the point C to turn diode D1 on. The digital shift register of the control circuit means receives the negative pulse and the bistable device F1F'1 which was in the 1,0 state (on, off state) is changed to the 0,1 state. The bistable device F2F'2 receives a negative pulse from bistable device F1F'1. The bistable device F2F'2 was originally in the 1,0 state and, upon receiving the negative pulse from the bistable device F1F'1, is changed to the 0,1 state. The logic state of stage F1 is now 0 and the diode D4 is off. However, the logic state of F'2 is now 1 and the diode D5 is on. Since the diode D5 is on, the voltage at point B is zero volts and the voltage at point C returns to zero volts. Thus, the original condition of the tempo setting device is re-established.

The second time the switch S2 is depressed, the bistable device F1F'1 is actuated with a negative pulse in the same manner as described above. The bistable device F1F'1 immediately before the second depression of the switch S2 was in the 0,1 state and after the second depression of the switch S2 is changed to the 1,0 state. Thus, the output voltage of stage F'1 rises up and the bistable device F1F'1 produces a positive pulse. The bistable device F2F'2 is not actuated upon receipt of the positive pulse from the bistable device F1F'1. Since stages F1 and F'2 are now both in the on state, both diodes D4 and D5 are on. Therefore, the voltage at point B is zero volts and the voltage at point C returns to zero volts and the original condition of the tempo setting device is restored. Furthermore, the bistable stages F'1 and F2 are in the off state and the voltage at the point D is increased to be substantially the same as that of the power source B+ for the bistable devices F1F'1 and F2F'2, because the diodes D6 and D7 of the output control means are off. The positive voltage at point D causes the diode D8 to be off, enabling the oscillator 1 to function. This is the only logic output state of the digital shift register which through the output control means acitvates the oscillator 1 to the on condition.

The output of the oscillator 1 is connected to the logic circuit means comprising ripple counter F3F'3 through F6F'6 and a digital to analog converter formed by a standard combination of resistors and diodes. The input of the oscillator 1 is supplied during the interval between the second and the third depression of switch S2 and the four bistable devices F3F'3, F4F'4, F5F'5 and F6F'6 are successively actuated. The bistable devices are actuated by a positive pulse in the standard sequence of a ripple counter, refer to FIG. 3 for a standard timing diagram for a multistage ripple counter. Therefore, the bistable device F3F'3 is originally in the logic state 1,0 and upon receiving a positive pulse from oscillator 1 is actuated to the 0,1 logic state. Then the pulse received by the bistable device F4F'4 from bistable device F3F'3 is negative and bistable device F4F'4 remains in the 1,0 logic state. The second positive pulse received from oscillator 1 actuates the bistable device F3F'3 to the 1,0 logic state. The bistable device F3F'3 now produces a positive pulse to bistable device F4F'4 and the output state of bistable device F4F'4 changes to the 0,1 condition. The above sequence is continued in the standard well-known manner. It should be apparent that any other standard type of counter can be used to receive the pulses from the oscillator 1.

The outputs of the individual bistable devices F3F'3 through F6F'6 of the ripple counter are combined at the point F through a digital to analog converter network. The network illustrated comprises a standard combination of resistances R6 through R11 and diodes D13 through D15 producing a combined voltage corresponding to the number of pulses received from the oscillator 1. For example, when the interval between the second and third depression of the switch S2 is shortest, only bistable device F3F'3 is actuated. The voltage at point F due to the network with only F3F'3 actuated to the 0,1 logic state would the be calculated as:

$$V_F = \frac{(R_7 // R_8 // R_9 // R_{10} // R_{11})}{R_6 + (R_7 // R_8 // R_9 // R_{10} // R_{11})} v$$

with the symbol // indicating "in parallel combination with" and $v$ indicating the supply voltage for the ripple counter.

Figure 4:
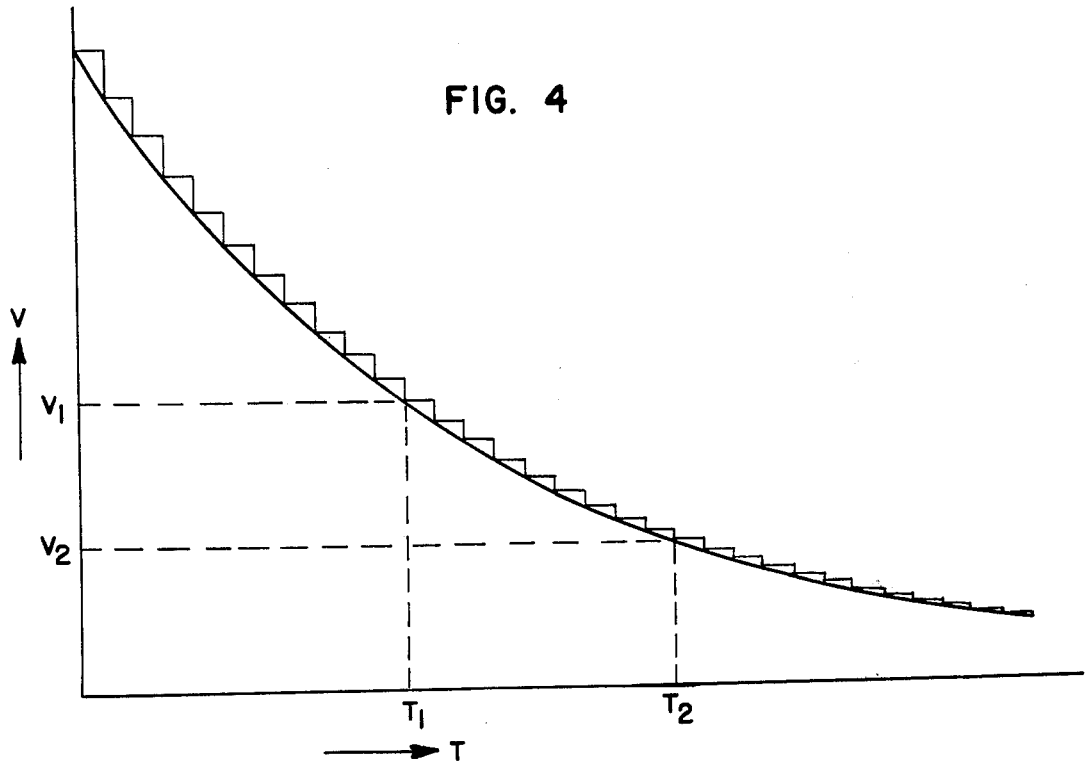
FIG. 4 is a graph showing the relationship between the combined output voltage and the depression timing period for the device illustrated in FIG. 2.

The combined voltage output at point F progressively changes as the ripple counter steps through its sequence and is related to the length of time the oscillator 1 is on. A standard curve for a progressively diminishing voltage magnitude of the combined output voltage is illustrated in FIG. 4. It should be apparent to a person of ordinary skill that a curve of different slope and either progressively increasing or decreasing voltage magnitude of the combined output voltage can be obtained by obvious modifications of the logic circuit.

The tempo oscillator 2 of the automatic rhythm instrument is responsive to the combined voltage signal for controlling the tempo in accordance with the time interval established by the repeated actuation of switch S2. The voltage controlled tempo oscillator 2 has an output frequency which corresponds to the magnitude of its input voltage. The control signal applied to the input of the voltage controlled tempo oscillator 2 is the combined output voltage of the circuit means of the tempo regulating device which is present at the point F. Thus, the time interval between the second and third depressions of the switch S2 determines the length of time which the oscillator 1 will be on and therefore, the corresponding combined voltage which will appear at point F.

The third time the switch S2 is depressed, both of the bistable devices F1F'1 and F2F'2 are actuated by a negative pulse generated in the same manner as described above. The bistable device F1F'1 is changed to the 0,1 state and the bistable device F2F'2 is changed to the 1,0 state. The stages F1 and F'2 are in the off state, the diodes D4 and D5 of the inhibit circuit are changed to the off condition raising the voltage at the points B and C to substantially the same level as that of the power source B+ for the bistable devices. With the inhibit circuit producing the positive voltage at points B and C, the pulse converting circuit is disabled. In this condition, the pulse converting circuit will not produce an output pulse since the diode D1 is off and the capacitor C1 does not charge up so that further depression of the switch S2 will not cause a negative pulse to be produced at point C. The stages F'1 and F2 of the digital shift register are both in the on state causing diodes D6 and D7 to be on, the voltage at point D to become zero volts, and the diode D8 to be in the on state causing the oscillator of the circuit means to turn off. Now, regardless of the number of times the instrument player depresses the switch S2, the tempo remains the same. To select a different tempo, the reset switch S1 must be depressed thereby resetting the tempo setting device to its original state and depressing the switch S2 at the desired new tempo interval at least three times.

Figure 2:
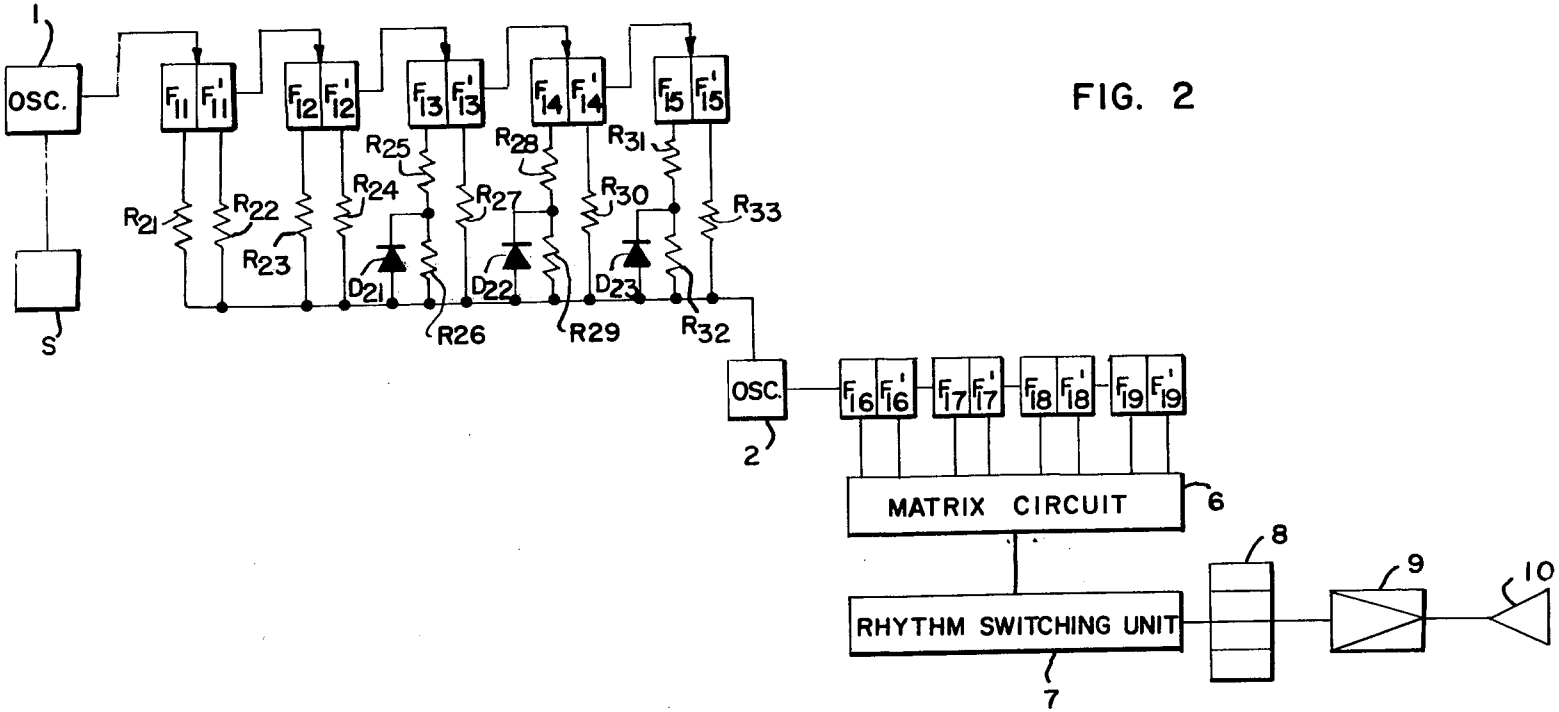
FIG. 2 is a block circuit diagram showing an alternate embodiment of the tempo setting control device.

FIG. 2 illustrates another embodiment of the present invention. A switch means S is connected to the oscillator 1. The output 1 is connected to the ripple counter comprising five bistable devices F11F'11, F12F'12, F13F'13, F14F'14 and F15F'15. The outputs of the individual stages of the ripple conter are provided with resistances and diodes in the following combinations R21, R22; R23, R24; R25, R26, R27, D21; R28, R29, R30, and D22; R31, R32, R33 and D23. The outputs of the individual bistable devices are jointly connected through the above combination of resistances and diodes to form a control signal corresponding in magnitude to the rate the instrument player actuates the switch means. The control signal is applied to a tempo regulating oscillator 2. The output of the tempo oscillator 2 is connected to a frequency divider containing bistable devices F16F'16, F17F'17, F18F'18 and F19F'19. The output of the frequency divider is connected to a standard matrix unit 6 which is connected to a well-known rhythm switching unit 7, which is connected to a standard sound oscillator 8. The output of oscillator 8 is connected to a standard amplifier 9 and the output of the amplifier 9 is connected to a standard loud speaker 10. The elements 1 and 2 and 6 through 10 are well-known in the art and are not described further herein.

Figure 3:
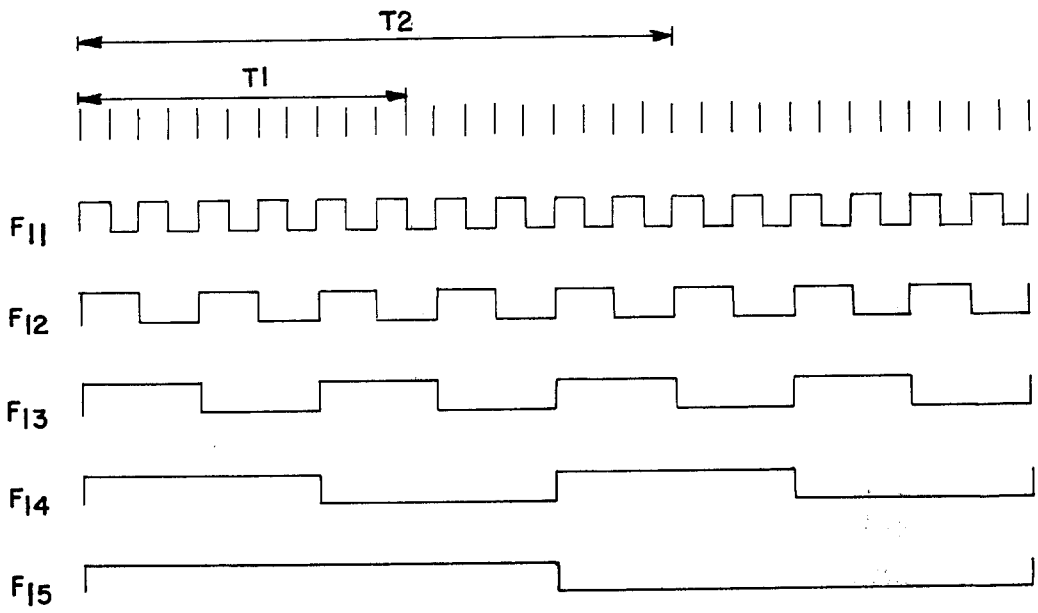
FIG. 3 is a timing waveform diagram for the device illustrated in FIG. 2.

The input wave forms to bistable stages F11, F12, F13, F14 and F15 are illustrated in FIG. 3. The resistances connected to the output of the bistable devices F11, F12, F13, F14 and F15 are the resistances R21, R22, R23, R25, R26, R28, R29, R31 and R32. To select a desired tempo, the player depresses the switch S for a predetermined period of time T1 which corresponds to the desired tempo. The oscillator 1 generates pulses for the period of time T1. The states of the bistable devices are illustrated in FIG. 3 for the period of time T1. The combined voltage V1 for the time period T1 is applied to the input of oscillator 2.

If the player depresses the switch S for a period of time T2 in accordance with the tempo desired, the state of the bistable device is again illustrated in FIG. 3. The combined output voltage V2 for the time period T2 is applied to the input of oscillator 2.

The voltage V1 is much greater than the voltage V2. The relation between the switch pressing time T corresponding to the output of oscillator 1 and the combined voltage produced is illustrated in FIG. 4. The selection of resistance values to provide the desired magnitude of the control voltage is standard and well-known in the art. The value of the combined voltage applied to the input of oscillator 2 diminishes with the length of time the switch S is depressed. If the switch S is depressed for a short period of time, a large combined voltage will be obtained and applied to the input of oscillator 2. The frequency of oscillator 2 will be high and produce a quick tempo. However, if the switch S is depressed for a long period of time, a smaller combined voltage will be applied to the input of oscillator 2. With the small input voltage applied to oscillator 2, the output frequency is low and the tempo correspondingly slower. It should be apparent to one of ordinary skill in the art that the relationship between a short depression time for switch S and a quick tempo and the long depression time for switch S and a slow tempo could be completely reversed by reversing the ralationship of the resistance values. If this is the case, a short depression time of switch S would result in a slow tempo while a long depression time of switch S would result in a quick tempo. To select a new tempo, the ripple counter must be reset by the instrument player by the actuation of any standard reset switch, not illustrated. It should be apparent that the control circuit means of FIG. 1 could be substituted for the switch S in this embodiment.

Figure 5:
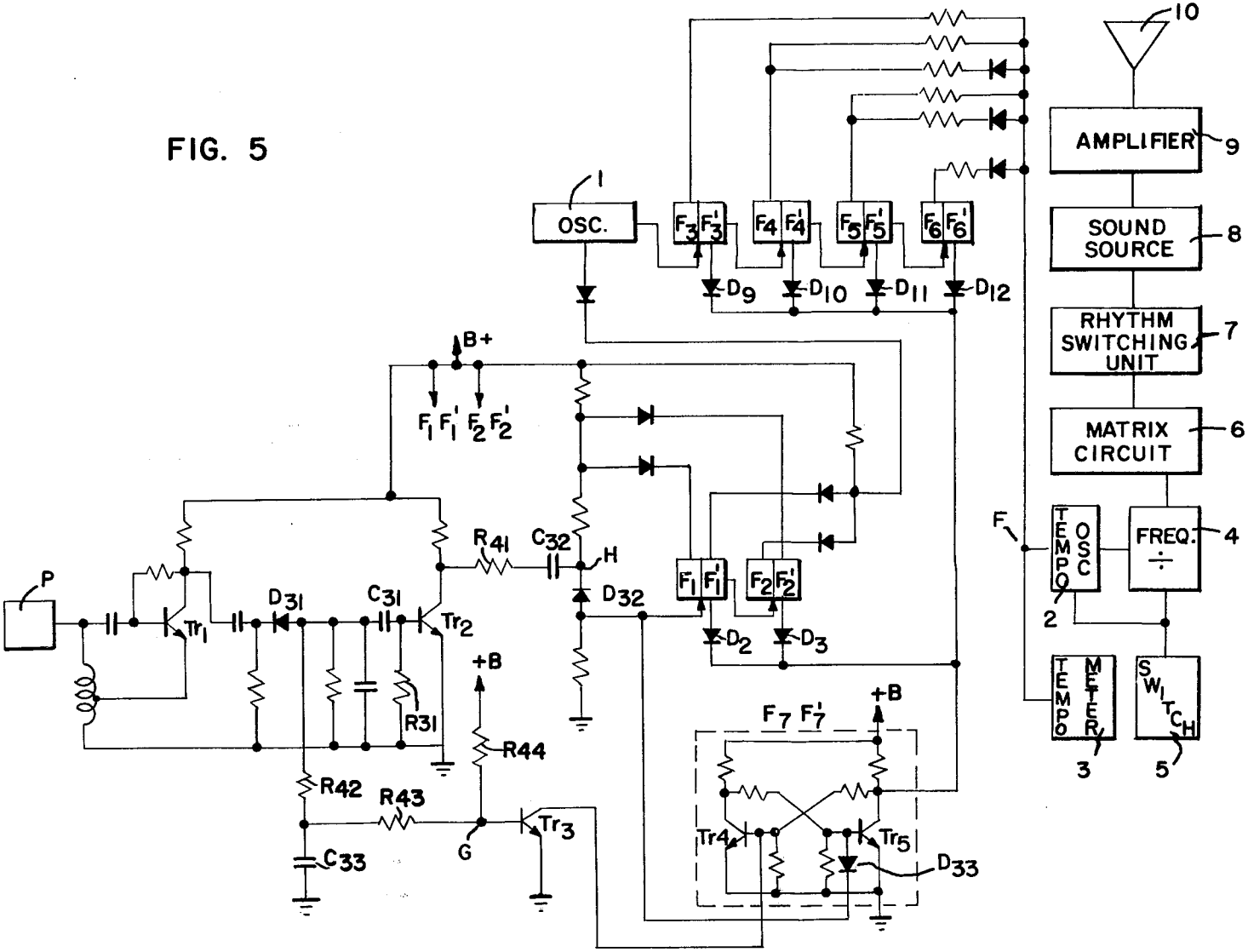
FIGS. 5 through 6 show additional alternate embodiments of the present invention.

FIG. 5 illustrates a third embodiment of the present invention. An interrupt means comprising a touch plate P is connected to the base of a transistor TR1 which forms, with its associated circuit components, an oscillator circuit. A diode D31 in series with a capacitor C31 is connected to the collector lead of transistor TR1 and is further connected to the base of transistor TR2. A pulse converting circuit comprising a resistance R41, capacitor C32 and a diode D32 is connected to the collector lead of transistor TR2 and to the input of a binary shift register comprising two bistable devices F1F'1 and F2F'2. A timing circuit comprising a resistor R42 in series with a capacitor C33 is connected to a point between the diode D31 and capacitor C32 and is connected to ground. At a point between the resistor R42 and capacitor C33 a resistor R43 is connected and is also connected to the base of transistor TR3. The time constant for the capacitor C33 and the resistance R42 is predetermined so that the mere quick touching of the plate P does not provide a sufficient time for the rise in the voltage at the point G to satisfy the forward directional characteristic voltage Vbe of the transistor TR3 in response to the change in anode voltage of diode D31. The emitter of transistor TR3 is grounded and the collector of TR3 is connected to the reset switch means comprising bistable device F7F'7. The base of the transistor TR3 is connected to the power supply through resistor R44. The bistable device F7F'7 comprises a transistor TR4 the base of which is connected to the collector of transistor TR3 and a transistor TR5 the base of which is connected through diode D33 to a point between the diode D32 and the bistable device F1F'1 of the digital shift register.

The bistable stages F'1 and F2 are connected through an output control circuit as described with reference to FIG. 1 to a circuit means. The circuit means comprises an oscillator 1 and a logic circuit as previously detailed with reference to FIG. 1. The logic circuit comprises four bistable devices F3F'3, F4F'4, F5F'5 and F6F'6.

The bistable stages F'1, F'2, F'3, F'4, F'5, F'6 are connected to the base of transistor TR4 of bistable stage F'7 through diodes D2, D3, D9, D10, D11 and D12 respectively. The bistable stages F3, F4, F5, an F6 are connected to a tempo oscillator 2 and a meter 3 in the same manner as in the embodiment of FIG. 1. The output of the tempo regulating oscillator 2 is connected to a frequency divider 4 and to a start switch 5. The frequency divider 4 is connected to the input of a matrix circuit 6. The output of the matrix circuit 6 is connected to rhythm swithching unit 7. The output of the rhythm switching unit is connected to the input of a sound oscillator 8, the output of which is connected to an amplifier 9, the output of which is connected to a loud speaker 10. The elements 1 through 10 are all standard and well-known in the art and no further description herein is deemed necessary.

The transistor TR1 of the oscillating circuit is normally on and maintains a negative voltage at the anode of diode 31 through rectification of the alternating current signal presented at its cathode. The transistors TR2 and TR3 are normally off. To reset the tempo setting device, the player touches the touch plate for a time period sufficient to turn the oscillator circuit involving transistor TR1 off so that the negative voltage at the anode of diode 31 disappears long enough that the voltage at point G rises up beyond the forward directional characteristic voltage Vbe between the base and emitter of transistor TR3. Transistor TR3 then turns on. With transistor TR3 on, the transistor TR4 of bistable device F7F'7 is off since its base is grounded. This enables the transistor TR5, part of bistable device F7F'7, to turn on and maintain its on stage. The bistable stages F'1, F'2, F'3, F'4, F'5 and F'6 are off since each diode D2 through D12 is on. The tempo setting device is now reset. The instrument player then taps or quickly touches the plate P a predetermined number of times at a rate of time in accordance with his desired tempo.

When the player quickly touches or taps the plate P the first time, the anode of diode D31 again changes from negative voltage to zero voltage. In the triggering circuit, the capacitor C31 starts to charge and the base of transistor TR2 becomes positive due to the charging current through R31 thereby causing the transistor TR2 to be in the on condition. When the transistor TR2 becomes on, its collector has substantially the same potential as ground. The capacitor C32 was previously charged and the point H had substantially the potential of ground. As transistor TR2 turns on and its collector goes to ground, a negative pulse is generated at the point H which passes through the diode D32 and the diode D33. The negative pulse causes the transistor TR5 to change from the on to the off state and accordingly the transistor TR4 changes to the on state. The negative pulse also actuates the digital shift register means including bistable device F1F'1. The bistable device F1F'1 is in the 1,0 state and the negative pulse passed by diode D32 actuates the flip-flop F1F'1 to the state 0,1. The negative pulse generated by the flip-flop F1F'1 actuates flip-flop F2F'2 to the state 0,1.

The second time the plate P is tapped the same sequence as above described generates a negative pulse at the point H which activates the bistable device F1F'1. The negative pulse is passed to the diode D33, but since the transistor TR5 is in the off state the bistable device F7F'7 is not actuated and does not change state. The negative pulse is passed by diode D32 and actuates the bistable device F1F'1 to the state 1,0. A positive pulse is now generated by bistable device F1F'1 and bistable device F2F'2 is not actuated and remains in the 0,1 state. The oscillator 1 is now on based on the same circuit operation as described with respect to FIG. 1.

When the plate P is tapped a third time, the same procedure is again instigated to generate a negative pulse at the point H thereby actuating the bistable device F1F'1. The flip-flop F1F'1 now changes to the 0,1 state. The negative pulse from bistable device F1F'1 actuates bistable device F2F'2 to the 1,0 state. The oscillator 1 is turned off and subsequent negative pulses will not be generated at point H based on the same circuit functions described with respect to FIG. 1. Thus, in correspondence with the interval of time between the second and third taps of the plate P, the series of bistable devices F3F'3, F4F'4, F5F'5, F6F'6 of the ripple counter are successively actuated through the oscillator 1. The combined voltage output of these bistable devices forms the control signals which regulate the tempo oscillator 2 to provide the desired tempo in the same manner as the embodiment in FIG. 1.

Figure 6:
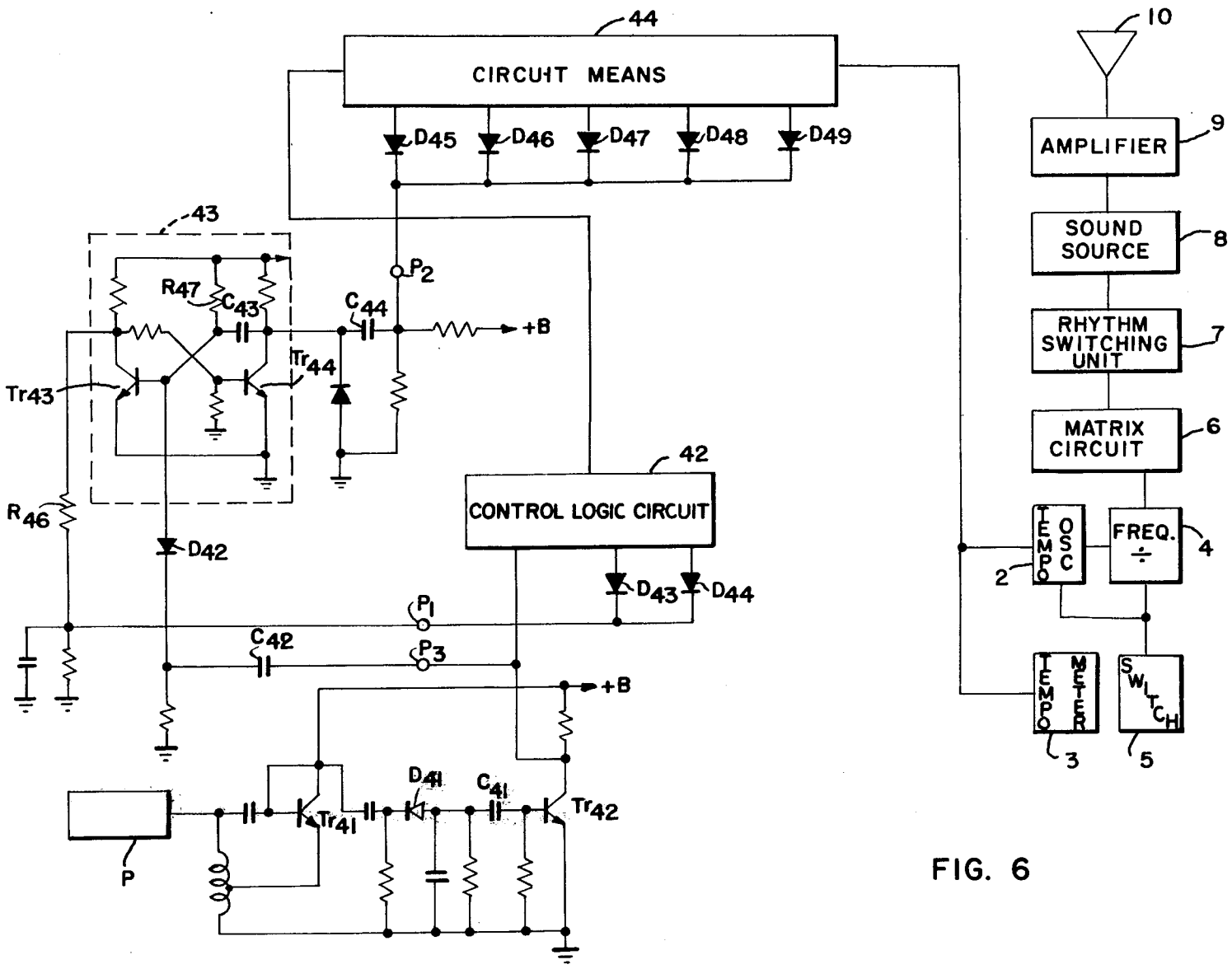

FIG. 6 discloses another embodiment utilizing the touch plate. The touch plate P is connected to the base of the transistor TR41 which is normally on and with its related circuit components comprises a typical oscillator circuit. A diode D41 in series with a capacitor C41 is connected to the collector of the transistor TR41 and is connected to the base of transistor TR42. The emitter of transistor TR42 is connected to a control logic circuit identical to the control logic circuit illustrated and described in the embodiment of FIG. 1. Furthermore, the collector of transistor TR42 is connected to a monostable multivibrator 43 through a capacitor C42 and a diode D42. It is predetermined that the monostable multivibrator including a capacitor C43 and a resistor R47 has a time constant that is much longer than the slowest of any of the desired tempos which can be set and that the capacitance of capacitor C42 is much greater than that of capacitor C43. The collector of the transistor TR44 of the monostable multivibrator 43 is connected to a circuit means identical to the circuit means described and illustrated in the embodiment of FIG. 1. A tempo oscillator 2 and a tempo indicator 3 are jointly connected to the control signal output of the circuit means 44. The tempo oscillator 2 is connected to a switch 5 and a frequently divider 4. The frequency divider 4 is connected to a matrix circuit 6, the output of which is connected to a rhythm switching unit 7, the output of which is connected to a sound source 8, the output of which is connected to an amplifier 9 and the output of which is connected to a loud speaker 10. The elements 2 through 10 are standard and well-known in the art and no further description thereof is deemed necessary.

The transistor TR41 of the oscillating circuit is normally on and maintains a negative voltage at the anode of the diode D41 due to the rectification of the AC signal output of the oscilator. The transistor TR42 is normally off. The transistor TR43 is the monostable multivibtator 43 is on and the transistor TR44 on the monostable multivibrator 43 is off. There is no voltage at the point P1 and the control logic circuit 42 is in the reset state through the diodes D43 and D44.

The touch plate P is actuated by tapping a predetermined number of times at the desired tempo by theinstrument player. When the plate P is first tapped, the transistor TR41 turns off and accordingly the voltage at the anode of the diode D41 is no longer negative. The transistor TR42 turns on briefly and a negative pulse is generated by the capacitor C42. This negative pulse coupled through diode D42 causes transistor TR43 of the monostable multivibrator 43 to turn off and the transistor TR44 to turn on. The output of the monostable multivibrator 43 causes capacitor C44 to generate a negative pulse at the point P2 thereby resetting the circuit means 44. The collector of transistor TR43 of the monostable multivibrator 43 has a positive voltage and raises the voltage at the point P1 through the resistance of R46 to remove the reset on the control logic means 42. The time constant for the resistance R47 and the capacitor C43 in the monostable multivibrator 43 is predetermined to be longer than the time of the slowest desired and the capacitance of capacitor C42 is predetermined to be larger than that of the capacitor C43. The tapping of the plate P a second and third time at the desired tempo causes the circuit means 44 under control of the control logic circuit 42 to produce a control signal corresponding in magnitude to the desired tempo in the same manner as described with respect to the operation of FIG. 5.

If the plate P is not touched for a predetermined time longer than the time constant for the resistance R47 and the capicitor C43, the transistor TR43 turns on and the transistor TR44 is off and in this state the monostable multivibrator 43 returns to its normal condition. The collector voltage of transistor TR44 becomes high and a positive pulse is present at the point P2 due to the capacitor C44; but the circuit means 44 is not reset because of the presence of diodes D45 to D49. The collector voltage of the transistor TR43 of the monostable multivibrator 43 becomes lower and substantially zero voltage is present at the point P1 and control logic circuit 42 is thereby reset.

The tempo which is controlled by the tempo setting device can be changed by merely quickly tapping the plate P at the rate of time corresponding to the new desired tempo. It is not necessary to activate a resetting switch or to depress the plate P for a determined period of time due to the fact that the monostable multivibrator 43 is connected in series with the touch plate P. This embodiment simplifies the playing procedure and reduces the sequence of operations necessary for the player to select the desired tempo.

Other embodiments including a combination of the prior art rheostat control knob, the present invention and a switching means to select one or the other are contemplated to be within the scope of the present invention. It is to be understood that the present disclosure can be modified or varied by applying current knowledge without departing from the spirit and scope of the novel concepts of the invention.

I claim:

1. A tempo setting device for an automatic rhythm instrument which includes a tempo oscillator having an output frequency determined by the magnitude of an input control signal comprising:
   control means actuatable repetitively by an instrument player for producing a plurality of signals at a rate corresponding to a desired tempo; and
   circuit means for converting said signals into an input control signal related in magnitude to said rate.

2. A tempo setting device for an automatic rhythm instrument which includes a tempo oscillator having an output frequency determined by the magnitude of an input control signal comprising:
   control circuit means actuatable repetitively by an instrument player at a desired tempo producing a plurality of operate signals defining a selected time interval corresponding to said desired tempo; and
   circuit means responsive to said plurality of operate signals for producing an input control signal related in magnitude to said selected time interval.

3. A tempo setting device as claimed in claim 2 wherein said circuit means comprises:
   oscillator means responsive to said plurality of operate signals for producing output pulses during said selected time interval; and,
   logic circuit means responsive to said output pulses for producing said input control signal related in magnitude to the number of said output pulses.

4. A tempo setting device as claimed in claim 3, wherein said control circuit means comprises:
   switch means repetitively actuatable by an instrument player for producing a plurality of tempo indicating signals at said desired tempo; and,
   control logic circuit means responsive to said tempo indicating signals for producing said plurality of operate signals corresponding to a time interval between a preselected set of two of said tempo indicating signals.

5. A tempo setting device as claimed in claim 4, wherein said control logic circuit means comprises:
   pulse converting means responsive to said tempo indicating signals for producing pulses;

a digital shift register responsive to said pulses for accumulating a number of said pulses;

output control means responsive to said digital shift register for producing said plurality of operate signals; and, inhibit means responsive to said digital shift register for disabling said pulse converting means.

6. A tempo setting device as claimed in claim 5 including:

a reset switch actuatable by said instrument player to reset said digital shift register and said logic circuit means.

7. A tempo setting device as claimed in claim 4, wherein said switch means comprises:

an oscillating means for supplying a maintain signal, interrupt switch means actuatable repetitively by said instrument player to disable said oscillating means for supplying said maintain signal; and trigger circuit means responsive to each absence of said maintain signal for producing one of said tempo indicating signals.

8. A tempo setting device as claimed in claim 7, including:

timing circuit means responsive to the absence of said maintain signal for a predetermined time period for producing an enable signal, and reset circuit means responsive to said enable signal for resetting said digital shift register and said logic circuit means.

9. A tempo setting device as claimed in claim 4 including:

a timed reset circuit means responsive to the first of said tempo indicating signals to reset said logic circuit means, and said timed reset circuit means responsive to the absence of said tempo indicating signals for a predetermined time period to reset only said control logic circuit means.

10. A tempo setting apparatus for producing tempo signals for an automatic rhythm instrument comprising:

control circuit means actuatable repetitively by an instrument player at a desired tempo producing a plurality of operate signals defining a selected time interval corresponding to said desired tempo; and, circuit means responsive to said operate signals for producing tempo signals related to said selected time interval.

11. A tempo setting device as claimed in claim 10 wherein said control circuit means comprises:

switch means repetitively actuatable by an instrument player for producing without generating audible tones a plurality of tempo indicating signals at said desired tempo; and, control logic circuit means responsive to said tempo indicating signals for producing said plurality of operating signals corresponding to a time interval between a preselected set of two of said tempo indicating signals.

12. A tempo setting device as set forth in claim 11, wherein said switch means comprises:

an oscillator means for supplying a maintained signal;

interrupt switch means actuatable repetitively by an instrument player to disable said oscillating means from supplying said maintained signal; and, trigger circuit means responsive to each absence of said maintained signal for producing one of said tempo indicating signals.

13. A tempo setting device as claimed in claim 11 including:

a timed reset circuit means responsive to the absence of said tempo indicating signals for a predetermined time period to reset said control logic circuit means.

* * * * *